United States Patent [19]

Walter et al.

[11] 4,195,218

[45] Mar. 25, 1980

[54] DRYER

[75] Inventors: Henry J. Walter, Wilton; Roy W. White, Norwalk, all of Conn.

[73] Assignee: Clairol Incorporated, New York, N.Y.

[21] Appl. No.: 829,543

[22] Filed: Aug. 31, 1977

[51] Int. Cl.[2] ..... H05B 1/02

[52] U.S. Cl. ..... 219/370; 415/121 B

[58] Field of Search ..... 219/366, 369–371, 219/373, 374, 399, 380; 415/121 B

[56] References Cited

U.S. PATENT DOCUMENTS

| | | | |
|---|---|---|---|
| 2,343,714 | 3/1944 | Enson | 415/121 B |
| 2,445,111 | 7/1948 | Gouinlock | 415/121 B |
| 2,445,111 | 7/1948 | Gouinlock | 415/121 B |
| 2,644,403 | 7/1953 | Dawson | 415/121 B |
| 2,763,795 | 9/1956 | Bradley, Jr. | 415/121 B |
| 2,817,000 | 12/1957 | Scheid | 219/369 |
| 2,997,569 | 8/1961 | Wagner | 219/379 |
| 3,060,483 | 10/1962 | Black, Jr. | 415/121 B |
| 3,375,983 | 4/1968 | Von Eiff et al. | 415/121 B |
| 3,492,462 | 1/1970 | Schumacher | 219/374 |
| 3,953,146 | 8/1974 | Sowards | 415/121 B |
| 3,961,758 | 6/1976 | Morgan | 415/121 B |

FOREIGN PATENT DOCUMENTS

| | | | |
|---|---|---|---|
| 501662 | 7/1930 | Fed. Rep. of Germany | 415/121 B |
| 90951 | 11/1937 | Sweden | 415/121 B |
| 146935 | 5/1931 | Switzerland | 415/121 B |

*Primary Examiner*—C. L. Albritton
*Assistant Examiner*—Bernard Roskoski
*Attorney, Agent, or Firm*—Gerald S. Rosen; George A. Mentis; David J. Mugford

[57] ABSTRACT

In a hair dryer having a housing including air inlets, a motor for driving a fan which draws air into the housing through the air inlets and blows the air over a heating element to discharge the heated air through air outlets, the improvement which includes providing abrasive means in the housing for cutting loose hairs which enter the dryer with the incoming air and become entrapped about the fan blades or motor shaft, thereby preventing the hair from jamming the motor and permitting the cut hairs to be discharged from the dryer housing with the air coming out of the air outlets.

7 Claims, 6 Drawing Figures

AIR OUT
AIR IN
ABRASIVE
ABRASIVE
A
A
B
B
H
1
2
3
4
5
6
7
8
9
9a
10
11
12
13

DRYER

BACKGROUND OF THE INVENTION

Electric hair dryers are systems that produce heated air streams to dry hair. They have electric motor driven fans that suck in ambient air, compress and accelerate it, then channel the air stream over electric resistance heaters onto the users hair. As the same amount of air that is discharged from a dryer must be taken in, the possibility of foreign matter, especially hair, being sucked into the dryer is always present.

While dust and other particulate matter just passes through the dryer, hair has a tendency to wrap around turning spindles and objects. This problem is especially acute with hand held dryers that are used in or closely adjacent to hair. Further, hand held hair dryers use fast running motors that produce high velocity air streams. Hair entering the intake has a tendency to wind around the motor shaft and fill up the space between the rotating fan and the stationary bearing until the hair finally jams the fan.

With axial fans, where a close clearance between the tip of the fan and the shroud is maintained, hair causes an additional problem: Hair strands wind around the outside diameter of the fan, fill up the clearance gap and again jam the fan. Such a buildup of hair either about the motor shaft or in the small clearance space between the fan tip and fan shroud results in an additional torque load being placed on the motor which can greatly reduce the expected useful life of the motor. Also the motor speed is reduced causing less air to flow over the heating elements and resulting in the possible activation of the thermal shut off switch for the dryer due to excessively high air temperatures being reached in the dryer housing. This could be a great inconvenience since the dryer would be rendered useless to the user until proper servicing was made to the dryer to reset the shut off switch.

Attempts have been made to prevent hair from entering dryers by the use of screens at air inlets. They have not proven successful. Fine mesh screening or filtering requires extremely large intake areas and leads to clogging by airborn dust and dirt. Attempts to provide labyrinth guards between the rotating and stationary elements of a dryer were not successful as hair has a diameter of about 0.1 mm, and in a consumer product, which is mass produced, clearances of this order cannot be maintained. The use of contact seals, on the other hand, are wear points and require additional motor power which is not feasible in trying to keep the dryer of a compact size for portability.

It is pointed out that the prior art discloses the use of serrated or abrasive surfaces in pumping mechanisms for pumping liquids (e.g. U.S. Pat. Nos. 3,953,146 to Sowards and 3,961,758 to Morgan), as well as cutter knives in vacuum cleaners for cutting tape or yarn (.e.g. U.S. Pat. No. 3,060,483 to Black). However, there is no disclosure of hair dryers having abrasive means for cutting hairs which tend to jam the motor shaft thereby preventing rotation of the fan.

SUMMARY OF THE INVENTION

Figures 1, 2, 3, 4, 5, 6:
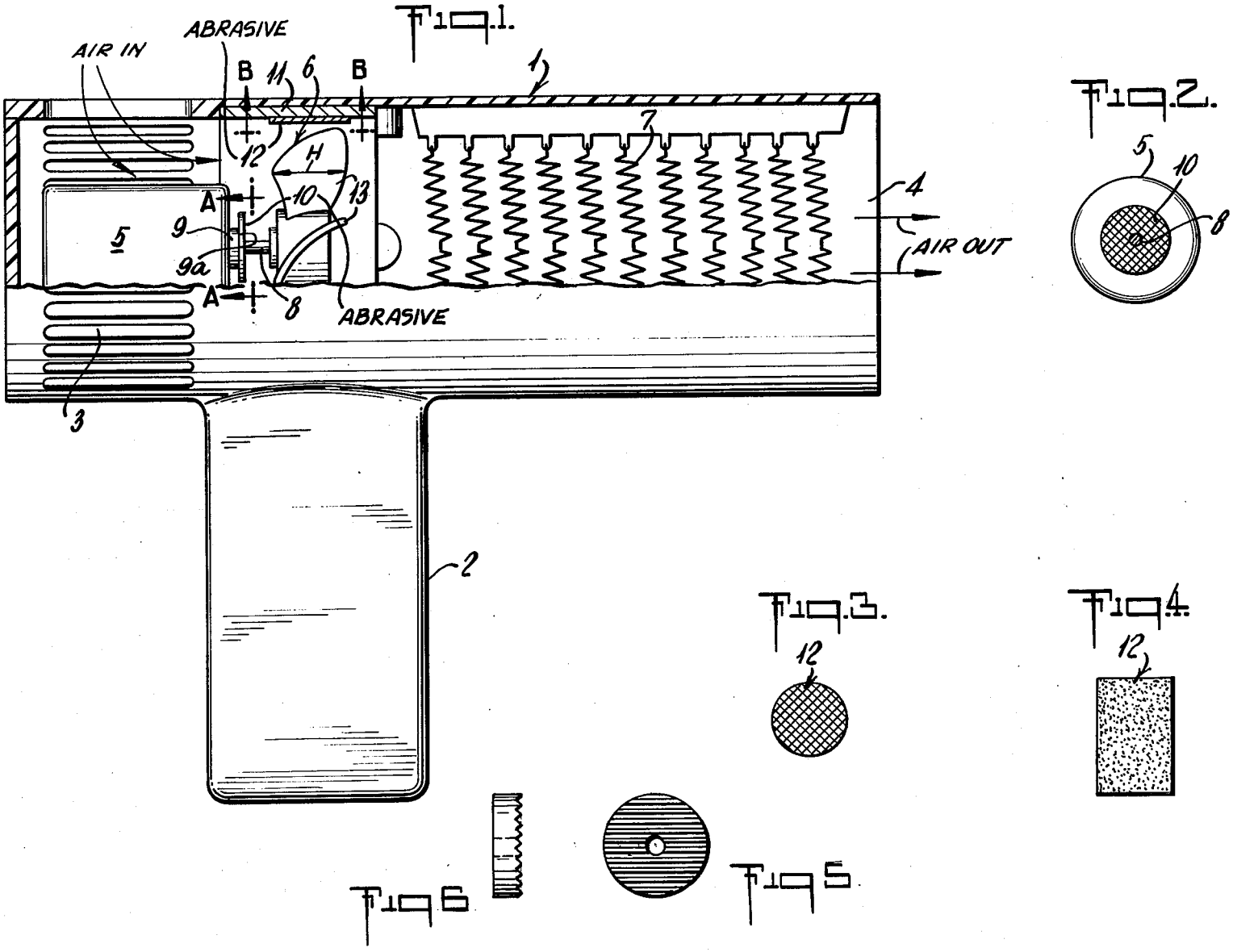
FIG. 1 is a side elevational view of the hair dryer showing a portion of casing removed.
FIG. 2 is a partial vertical section taken substantially along the lines A—A.
FIG. 3 is a partial vertical section taken along the lines B—B showing one embodiment of the first abrasive element.
FIG. 4 is a partial vertical section taken along the lines B—B showing another embodiment of the first abrasive element.
FIG. 5 is a partial vertical section taken substantially along the lines A—A of FIG. 1 showing a knurled abrasive surface embodiment of the abrasive element.
FIG. 6 is a side view of the knurled abrasive surface of FIG. 5.

It is an object of the invention to provide a hair dryer having a housing comprising an air inlet and an air outlet; electric heating means, a fan having a plurality of blades; a shaft having two ends, one end of which is secured to the axial center of said fan; a motor means connected to the other end of said shaft for rotating said fan; a motor shroud rigidly connected to said motor and surrounding the fan blades; a first abrasive element rigidly attached to said motor shroud adjacent to said blades, whereby a portion of loose hair which enters the dryer housing along with air through the air inlet and becomes entrapped about said blades is cut by said first abrasive element during rotation of the fan blades and said cut hair is discharged along with the air flowing through the dryer housing and out of the air outlet.

It is a further object to provide a dryer wherein the motor includes bearing means surrounding the shaft, the bearing means providing a surface, and a second abrasive element rigidly attached to the surface, whereby a portion of the loose hair which enters the dryer and becomes entrapped about the motor shaft between the fan and motor bearing surface is cut by the second abrasive element during rotation of the fan blades and the cut hair is discharged along with the air flowing through the dryer housing and out of the air outlet.

DETAILED DESCRIPTION OF THE INVENTION

It is an object of the instant invention to prevent hair from interferring with the performance of the fan in a hand held dryer. It was found that means to cut the hair strands so that they will become loose and be carried out with the air stream satisfies this objective.

It was found that when cutting or abrasive surfaces are interposed between the fan shaft and the motor mounting, hair wound around the shaft will be cut or abraded and blown off the shaft. Cutting or abrasive surfaces interposed between fan housing and fan tips will also cut or abrade hair wound around the fan, keep the fan clearance gap open, become loose, and will also be blown out of the dryer.

A small thin abrasive disc is attached to the inside diameter of the fan shroud (fan housing) severing hair wound around the fan blades. Small cutting or abrasive discs (washers) can be placed around the motor shaft to the stationary motor mount, which will sever hair wound around the rotating shaft. Dual action is obtained if an abrasive or cutting disc (washer) is placed around the shaft to the rotating fan also.

It is well known that hair entanglement is a problem especially in hand held hair dryers. The hair is drawn into the fan and motor with the air flow which cools the heaters. It is also well known that the hair has a propensity to wrap around the motor shaft between the front of the motor and the fan itself. Hair also tends to become tangled around the outside diameter of the fan. Many systems have been tried to exclude the hair from the fan and motor such as screens, baffles, etc., but to no avail since the diameter of hair is only 0.002" to 0.004".

It is the purpose of this invention to allow the hair to enter into the fan and motor area and then cut the hair into small pieces for expulsion or at least to remove it from the points where it would build up and stall the motor rendering the product inoperative. This is accomplished by putting an abrasive or cutting material at the strategic points. The abrasive could be sandpaper or merely sand or silicon oxide or aluminum oxide cemented or even a sharp cutting blade of steel or other material properly located. One strategic location is at the front surface of the motor bearing. Since the hair tends to wrap around the motor shaft, and the motor is stationary the abrasive will cut the hair when it builds up to the point where it would tend to stall the motor. The second location is on the inside of the shroud or housing which surrounds the fan. Since hair tends to tangle on the outside diameter of the fan it is cut by the abrasive or cutting material on the stationary shroud as the fan rotates.

Referring to now FIG. 1, the dryer includes dryer housing 1 and handle portion 2. Air inlet 3 is located at one end of the dryer housing and air outlet 4, which is in fluid flow communication therewith, is located at another end of the dryer housing. Motor means 5 located adjacent to the air inlet 3, contains a motor bearing 9 with a retainer surface 9*a*. The motor bearing engages a fan shaft 8 at one end whereas fan 6 engages the other end of shaft 8. The fan has a plurality of fan blades 13 each having a maximum height H. Surrounding said fan blades 13 within the housing 1 is a fan shroud 11 which is rigidly attached to said motor 5. Downstream of said fan 6 and before air outlet 4 is an electric heater element 7. Rigidly secured to the inner surface of the fan shroud 11 adjacent the fan blades 13 is a first abrasive element 12. Rigidly secured to motor bearing means surface 9*a* is a second abrasive element 10.

In operation, when the motor is turning the fan and the heater is on, air is drawn into the air inlet 3 by fan 6 and passes over the heater element 7, resulting in the discharge of heated air out of air outlet 4. If any loose hair enters the dryer with the air entering air inlet 3, and wraps itself about the shaft 8 between the second abrasive element 10 and the fan 6, or around the fan blades 13, the second and first abrasive elements will cut these hairs and such cut hairs will be discharged along with the heated air through outlet 4.

With respect to the abrasive elements it is noted that they may take any convenient shape such as discs, rectangles, squares, etc., however, depending on the particular location in the dryer it may be preferable to utilize one shape over the other. Thus it is preferred that the second abrasive element can take the shape of a disc and the first abrasive element may be shaped as a disc or a rectangle. It is preferred with respect to the first abrasive element that the dimensions thereof be such that they be substantially as great as the height of the blade to insure adequate cutting of loose hairs attached to the blade.

The abrasive elements may be made of any materials which in fact promote a cutting or disintegration of hair such as sandpaper, knurled metal surfaces, or metal cutting blades. With respect to sandpaper it is preferred that the particles be of a size such that the blade tip clears the abrasive material when the blade is rotating and the abrasive element is fixed in place. Thus it is preferred that the particles be of a size smaller than 120 grit (i.e. capable of passing through the openings of a U.S. Sieve no. 120 screen) and even more preferably 240 grit (i.e. capable of passing through the openings of a U.S. Sieve No. 200 screen). A particularly preferred embodiment is one wherein the abrasive element is waterproof paper containing particles of silicon carbide having a size of 240 grit.

What is claimed is:

1. A hair dryer having a housing comprising:

(a) an air inlet and an air outlet;

(b) electric heating means;

(c) a fan having a plurality of blades;

(d) a shaft having two ends, one end of which is secured to the axial center of said fan;

(e) motor means connected to the other end of said shaft for rotating said fan;

(f) a motor shroud rigidly connected to said motor and surrounding the fan blades;

(g) a first abrasive element rigidly attached to said motor shroud adjacent to said blades, whereby a portion of the loose hair which enters the dryer housing along with air through the air inlet and becomes entrapped about said blades is abraded by said first abrasive element during rotation of the fan blades and said abraded hair is discharged along with the air flowing through the dryer housing and out of the air outlet; wherein said motor includes bearing means surrounding said shaft, said bearing means providing a surface, and a second abrasive element rigidly attached to said surface, whereby a portion of said loose hair which enters the dryer and becomes entrapped about said motor shaft between the fan and motor bearing surface is abraded by said second abrasive element during rotation of the fan blades and said abraded hair is discharged along with the air flowing through the dryer housing and out of the air outlet wherein said first and second abrasive elements are shaped as discs.

2. A hair dryer having a housing comprising:

(a) an air inlet and an air outlet;

(b) electric heating means;

(c) a fan having a plurality of blades;

(d) a shaft having two ends, one end of which is secured to the axial center of said fan;

(e) motor means connected to the other end of said shaft for rotating said fan;

(f) a motor shroud rigidly connected to said motor and surrounding the fan blades;

(g) a first abrasive element rigidly attached to said motor shroud adjacent to said blades, whereby a portion of the loose hair which enters the dryer housing along with air through the air inlet and becomes entrapped about said blades is abraded by said first abrasive element during rotation of the fan blades and said abraded hair is discharged along with the air flowing through the dryer housing and out of the air outlet;

wherein said motor includes bearing means surrounding said shaft, said bearing means providing a surface, and a second abrasive element rigidly attached to said surface, whereby a portion of said loose hair which enters the dryer and becomes entrapped about said motor shaft between the fan and motor bearing surface is abraded by said second abrasive element during rotation of the fan blades and said abraded hair is discharged along with the air flowing through the dryer housing and out of the air outlet wherein said second abrasive element is shaped as a disc and said first abrasive element is shaped as a rectangle.

3. The dryer of claim 1 wherein said first and second abrasive elements consist essentially of sandpaper with an adhesive backing.

4. The dryer of claim 3 wherein said sandpaper consists essentially of abrasive particles secured to a paper backing, wherein said particles are selected from the group consisting of silicon carbide, silicon oxide, and aluminum oxide.

5. The dryer of claim 4 wherein said particles are having a size so that the particles are capable of passing through the openings of a U.S. Sieve No. 200 screen.

6. The dryer of claim 5 wherein said paper is waterproof paper and said particles are silicon carbide of 240 grit size.

7. The dryer of claim 1 wherein said first and second abrasive elements consist essentially of knurled metal surfaces.

* * * * *